US005526615A

United States Patent [19]

Kaizu et al.

[11] Patent Number: 5,526,615

[45] Date of Patent: Jun. 18, 1996

[54] AUTOMATIC TRANSACTION MACHINE STORING APPARATUS

[75] Inventors: Takuya Kaizu, Shibata; Hidetoshi Kaneta, Nakajo-machi; Rikuro Oosawa, Niigata; Tutomu Yamanishi, Shibata, all of Japan

[73] Assignee: Hitachi, Ltd., Tokyo, Japan

[21] Appl. No.: 218,893

[22] Filed: Mar. 28, 1994

[51] Int. Cl.[6] ..... E05G 1/00; E05G 1/06; E05G 1/10

[52] U.S. Cl. ..... 52/79.6; 52/79.1; 52/65; 49/40; 109/2; 109/11; 109/38; 109/39; 109/48; 109/49.5; 109/53; 186/37; 902/30; 902/31; 902/35; D99/28

[58] Field of Search ..... 109/2–13, 21–24, 109/31–33, 38–42, 48, 49.5, 53–55, 58–59, 78, 87; 52/79.1, 79.6, 27.5, 27, 65; 902/30–35; 186/37, 53, 55; D99/28, 43; 49/40

[56] References Cited

U.S. PATENT DOCUMENTS

| | | | |
|---|---|---|---|
| D. 263,344 | 3/1982 | McCarthy et al. | D99/28 |
| D. 278,176 | 3/1985 | Root | D99/28 |
| D. 286,098 | 10/1986 | Prinzhorn | D99/28 |
| 2,283,542 | 5/1942 | Dorsey | 109/4 |
| 3,377,080 | 4/1968 | Bartley et al. | 52/27.5 X |
| 4,348,966 | 9/1982 | Hastings | 49/40 X |
| 4,497,261 | 2/1985 | Ferris et al. | 109/2 |
| 4,884,514 | 12/1989 | Shockey et al. | 109/2 X |
| 5,379,704 | 1/1995 | Couvrette | 109/2 X |

FOREIGN PATENT DOCUMENTS

| | | | |
|---|---|---|---|
| 34093 | 8/1981 | European Pat. Off. | 52/27 |
| 66500 | 12/1982 | European Pat. Off. | 109/48 |
| 2385873 | 12/1978 | France | 109/38 |
| 2393378 | 2/1979 | France | 109/40 |
| 2844225 | 4/1980 | Germany | 109/10 |

*Primary Examiner*—Carl D. Friedman
*Assistant Examiner*—Laura A. Saladino
*Attorney, Agent, or Firm*—Fay, Sharpe, Beall, Fagan, Minnich & McKee

[57] ABSTRACT

An automatic transaction machine storing apparatus for storing a plurality of automatic transaction machines. The apparatus includes a plurality of entrances for respectively carrying the automatic transaction machines therethrough into a customer room. The entrances are provided in front of set positions of the automatic transaction machines. A machine room defined behind the customer room has a space for maintenance of each automatic transaction machine or cash exchange. Furthermore, the apparatus further includes a plurality of security sensors provided on an outer panel of the apparatus to detect an external attack and a control unit for rotationally driving a rotating table on which each automatic transaction machine is mounted at a required angle according to information output from the security sensors, thereby orienting a security panel standing on the rotating table toward an attacked position to secure the automatic transaction machine against the external attack.

9 Claims, 11 Drawing Sheets

AUTOMATIC TRANSACTION MACHINE STORING APPARATUS

BACKGROUND OF THE INVENTION

1. Field of the Invention

The present invention relates to an automatic transaction machine storing apparatus for storing an automatic transaction machine such as an automatic teller machine and an automatic ticket vending machine, and more particularly to an automatic transaction machine storing apparatus improved in operability and maintainability of automatic transaction machines, transportability and reduction in installation area, and security.

2. Description of the Prior Art

FIG. 6 is a horizontal sectional view of an automatic transaction machine storing apparatus (which will be hereinafter referred to as a booth) in the prior art, wherein two automatic transaction machines 20*a* and 20*b* are arranged in the booth so as to be juxtaposed in the lateral direction of the booth.

The booth is constructed of an entrance 1, two side walls 3*a* and 3*b*, a rear wall 24, two front glass walls 25*a* and 25*b*, and two side glass walls 26*a* and 26*b*, thus defining an enclosed space. In this enclosed space of the booth, there are provided two rotating tables 7*a* and 7*b* on which the automatic transaction machines 20*a* and 20*b* are placed, respectively, so that the automatic transaction machines 20*a* and 20*b* are adapted to be rotated together with the rotating tables 7*a* and 7*b*. The enclosed space is partitioned into a customer room 200 where a customer operates the automatic transaction machine 20*a* or 20*b* and a machine room 201 where a customer engineer maintains machinery. The rotating tables 7*a* and 7*b* are rotated by motors 11*a* and 11*b*, respectively. A maintenance door 13 for admitting the customer engineer is provided between the customer room 200 and the machine room 201. In installing the automatic transaction machines 20*a* and 20*b* into the booth, the automatic transaction machine 20*a* (shown by a dashed line) for example is carried from the entrance 1, then moved in a direction depicted by an arrow A to a position in front of the center of the rotating table 7*a*, and then moved in a direction depicted by an arrow B to a set position 20*a'* on the rotating table 7*a*. Thus, the automatic transaction machine 20*a* is set on the rotating table 7*a*. The other automatic transaction machine 20*b* is also similarly carried to a set position 20*b'* on the rotating table 7*b*. In maintaining the automatic transaction machines 20*a* and 20*b* placed on the rotating table 7*a* and 7*b* or exchanging cash in the automatic transaction machines 20*a* and 20*b*, a unit 21 of the automatic transaction machine 20*b* for example is drawn to a position shown by a dot-dash line in the customer room 200, and the customer engineer maintains the automatic transaction machine 20*b* or exchanges cash in the automatic transaction machine 20*b* in the customer room 200. As to the automatic transaction machine 20*a* also, the maintenance or the cash exchange is similarly performed in the customer room 200. Thus, the customer room 200 in the prior art booth serves also as a space for installation work of the automatic transaction machines 20*a* and 20*b* and as a space for maintenance work of the automatic transaction machines 20*a* and 20*b*. As a result, the depth of the customer room 200 must be greater than the depth of each automatic transaction machine 20*a* or 20*b*. Typically, such an automatic transaction machine has a width of 0.57 to 0.72 m, a depth of 1.02 to 1.09 m, and a height of 1.35 m. In consideration of this dimension of the automatic transaction machine and a dimension of the space for installation work and maintenance work, the depth of the booth is set to 2.6 m. Further, a floor of the booth has a thickness of about 10 cm which ensures wet prevention; a customer room of the booth has a height of about 2.3 m which does not give a sense of oppression to the customer; and a ceiling of the booth has a thickness of about 25 cm which ensures installation of wires and heat insulator. In consideration of these dimensions, the height of the booth is set to 2.65 m. The width of the booth is set freely to some extent in relation to an installation area of the booth.

Such a dimension of the booth in the prior art causes a problem in road carrying and site installation of the booth as an assembly. More specifically, according to Article 2 of the Road Carrying Vehicle Safety Standard now in force, the size of an automobile must not exceed 12 m in length, 2.5 m in width, and 3.8 m in height. Further, according to Article 22 of the Road Traffic Act Enforcement Order now in force, the length of cargo loaded on an automobile must not exceed the sum of the length of the automobile and one-tenth of the length of the automobile; the width of the cargo must not exceed the width of the automobile; and the height of the cargo must not exceed the height obtained by subtracting the height of a cargo loading part of the automobile from 3.8 m. In an ordinary truck, the width of a platform for loading cargo is set to about 2.44 m at most in consideration of an error in manufacture of the truck. Further, the height of the platform is set to 1.2 m in general, and in a low-platform truck, it is set to 1 m. In carrying the booth having a height of 2.65 m on the platform having a height of 1.2 m, the height of the truck in addition to the dimensions of a packaging member and a guard timber (about 9 cm square in cross section) put under the booth exceeds the upper limit 3.8 m of height defined by the above Enforcement Order. However, when a low-platform truck is used, the height of the truck can be maintained within the upper limit because the height of the platform is 1 m. On the other hand, the width of the booth is set to 2.6 m as mentioned above, so that it exceeds the upper limit 2.5 m of width defined by the above Safety Standard. Accordingly, the conventional booth cannot be carried by the ordinary truck. The use of a trailer instead of the ordinary truck may be considered. The trailer has a wide platform, but the platform is so high in general as to exceed the upper limit defined by the Enforcement Order. While there exists a special trailer having a low platform so as to clear the upper limit, the number of such special trailers existing is limited. Further, the trailer is largely vibrated during transportation in relation to springs. Further, as the trailer is a special vehicle, a transport cost becomes higher than that of the ordinary truck.

Incidentally, in developing store strategy of a financial institution, there has been an increased use of a capsule booth for storing an automatic transaction machine, to obtain a high level of safety and space-saving design which is not restricted in the sites at which it may be installed. Such a capsule booth is provided with a security panel standing on a rotating table on which the automatic transaction machine is placed. When the booth is in a closed condition, a front surface of the automatic transaction machine to be operated by the customer is covered with the security panel to thereby guard the automatic transaction machine. The booth is controlled by an automatic operating panel to operate the rotating table in receipt of a signal from a host system, e.g., a monitor signal from a security center.

As mentioned above, the prior art booth requires a large space for the customer room, so as to improve the workability of installation of the automatic transaction machine (ATMs) and the workability of maintenance of the automatic transaction machines. As a result, an installation area of the booth becomes large. Further, as the maintenance of the automatic transaction machines or the cash exchange is performed in the customer room, there is a problem in safety. Moreover, as a large space is required for the customer room as mentioned above, the depth of the booth becomes large to cause a difficulty in road carrying and site installation of the booth as an assembly.

Also in the aspect of security, there is a problem due to the control of the booth only by the signal from the host system in such a manner that a wide range of management such as a change in content of the control in improving a specification and a performance of the automatic transaction machine cannot be performed in the booth independently of the host system.

SUMMARY OF THE INVENTION

It is accordingly an object of the present invention to provide an automatic transaction machine storing apparatus which improves the workability of installation of automatic transaction machines.

It is another object of the present invention to provide an automatic transaction machine storing apparatus which can be carried by an ordinary truck.

It is a further object of the present invention to provide an automatic transaction machine storing apparatus which can perform effective control for security of an automatic transaction machine according to information from detecting means provided in the storing apparatus itself without receiving any signal from a host system.

According to an aspect of the present invention, a plurality of entrances are respectively provided in front of set positions of automatic transaction machines, so that the automatic transaction machines can be carried straight from the entrances to the set positions opposed to the entrances. Furthermore, the space defined between the adjacent automatic transaction machines installed is used as a maintenance space where a customer engineer can perform a maintenance work of either automatic transaction machine drawn.

Accordingly, the depth of the booth is set to a value not greater than 2.5 m which is an upper limit of width of an ordinary truck as defined by the Road Traffic Act Enforcement Order.

Since the entrances are respectively provided in front of the set positions of the automatic transaction machines, the depth of the customer room is not affected by the depth of each automatic transaction machine, and each automatic transaction machine can be carried straight from the corresponding entrance to the corresponding set position. Furthermore, since the space defined between the adjacent automatic transaction machines installed is used as a maintenance space where a customer engineer can perform a maintenance work of either automatic transaction machine drawn as required.

Moreover, since the depth of the booth is set to a value not greater than an upper limit of width of an ordinary truck as defined by the Road Traffic Act Enforcement Order, the booth as an assembly can be carried by the ordinary truck.

According to another aspect of the present invention, there is provided in an automatic transaction machine storing apparatus having a rotating table for mounting an automatic transaction machine, a security panel standing on the rotating table along an outer circumference thereof, and an outer panel surrounding the automatic transaction machine and the rotating table; the improvement comprising detecting means provided on an inside surface of the outer panel for detecting an abnormality having occurred on the outer panel, and drive control means for rotationally driving the rotating table at a required angle according to information output from the detecting means.

With this constitution, the rotating table can be controlled to be driven according to information from the detecting means provided in the storing apparatus irrespective of any signal from a host system.

Other objects and features of the invention will be more fully understood from the following detailed description and appended claims when taken with the accompanying drawings.

DETAILED DESCRIPTION OF THE PREFERRED EMBODIMENTS

Figure 4:
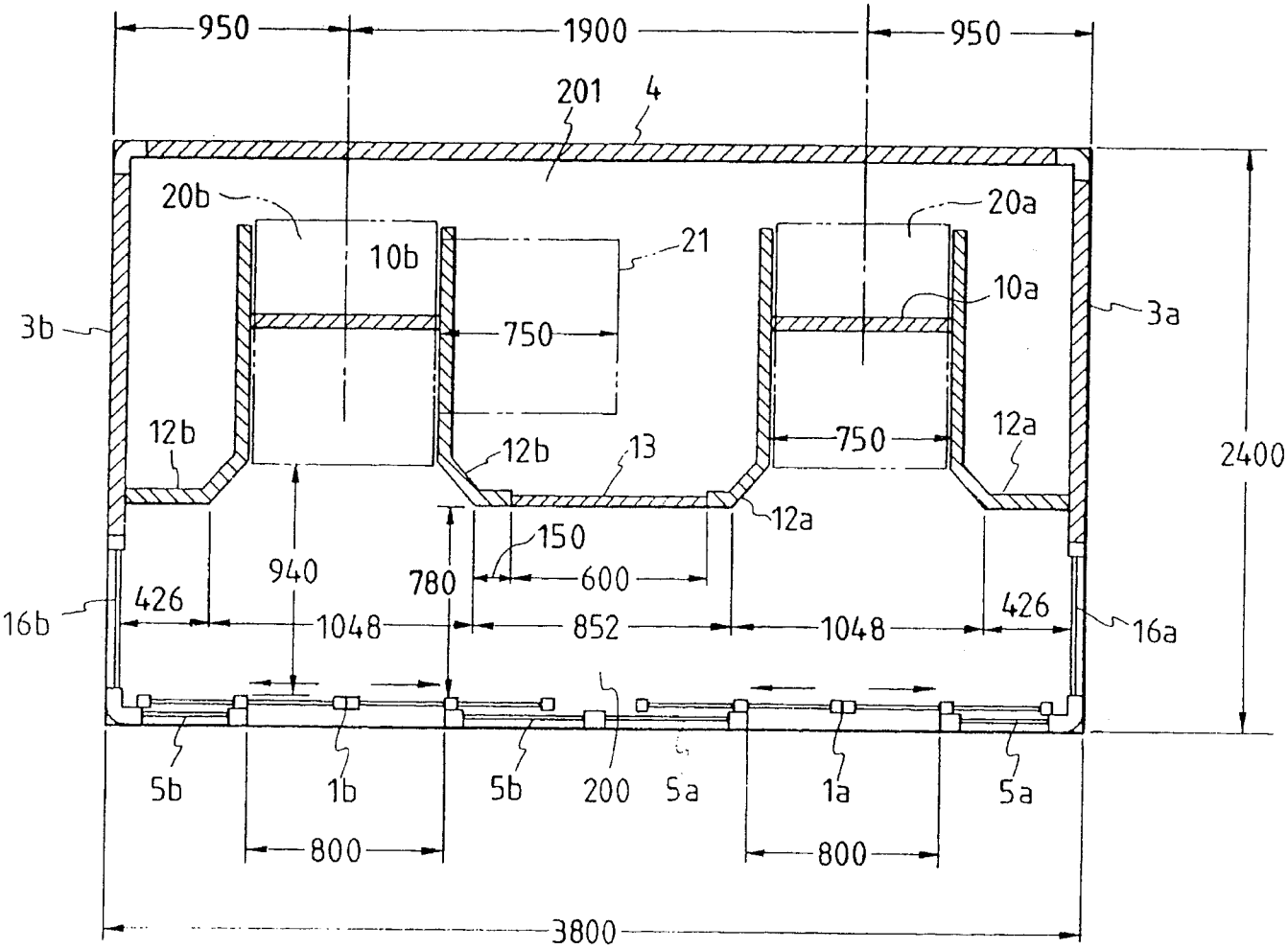
FIG. 4 is a horizontal sectional view of a booth according to a second preferred embodiment of the present invention.
Figure 5:
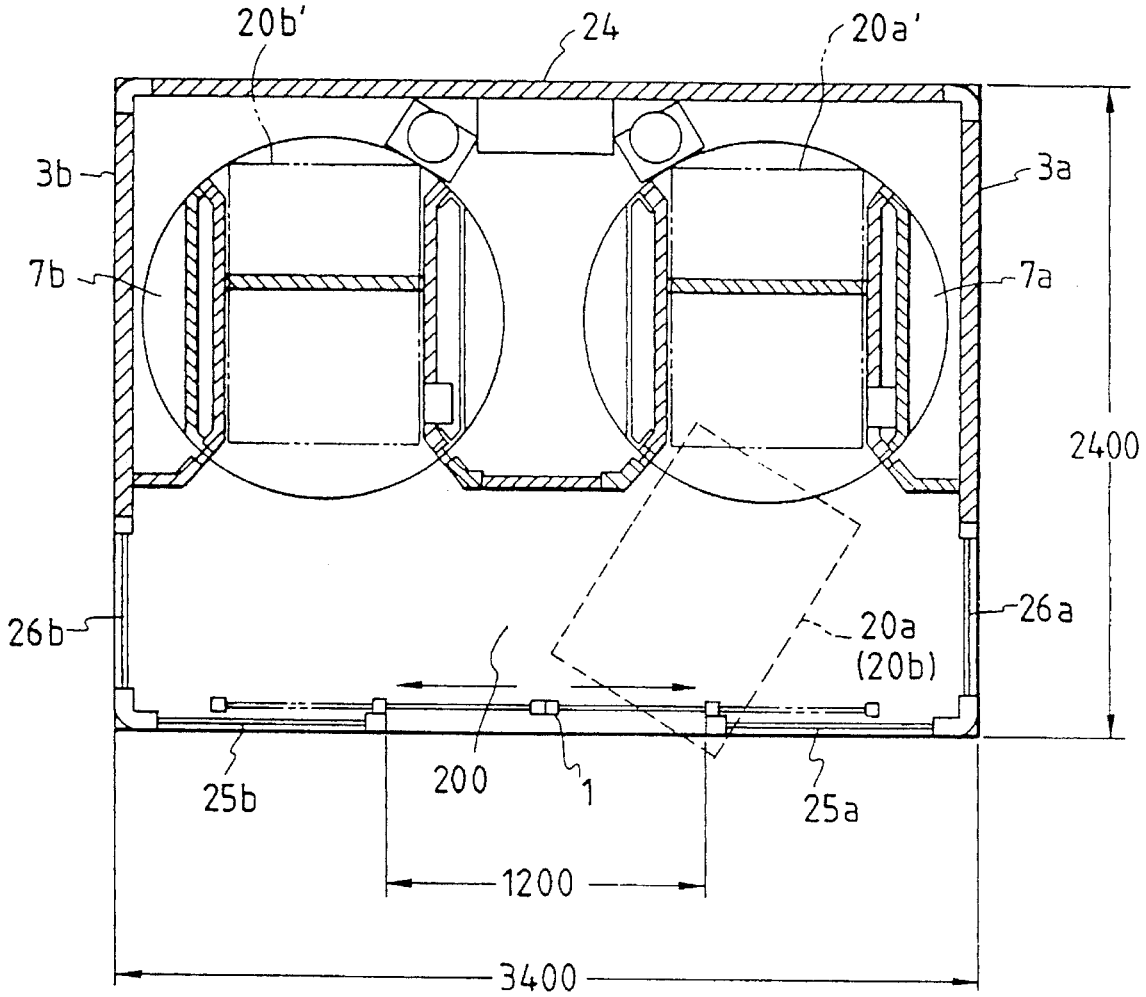
FIG. 5 is a horizontal sectional view of a booth reduced in depth, illustrating a problem in installation of an automatic transaction machine.
Figure 6:
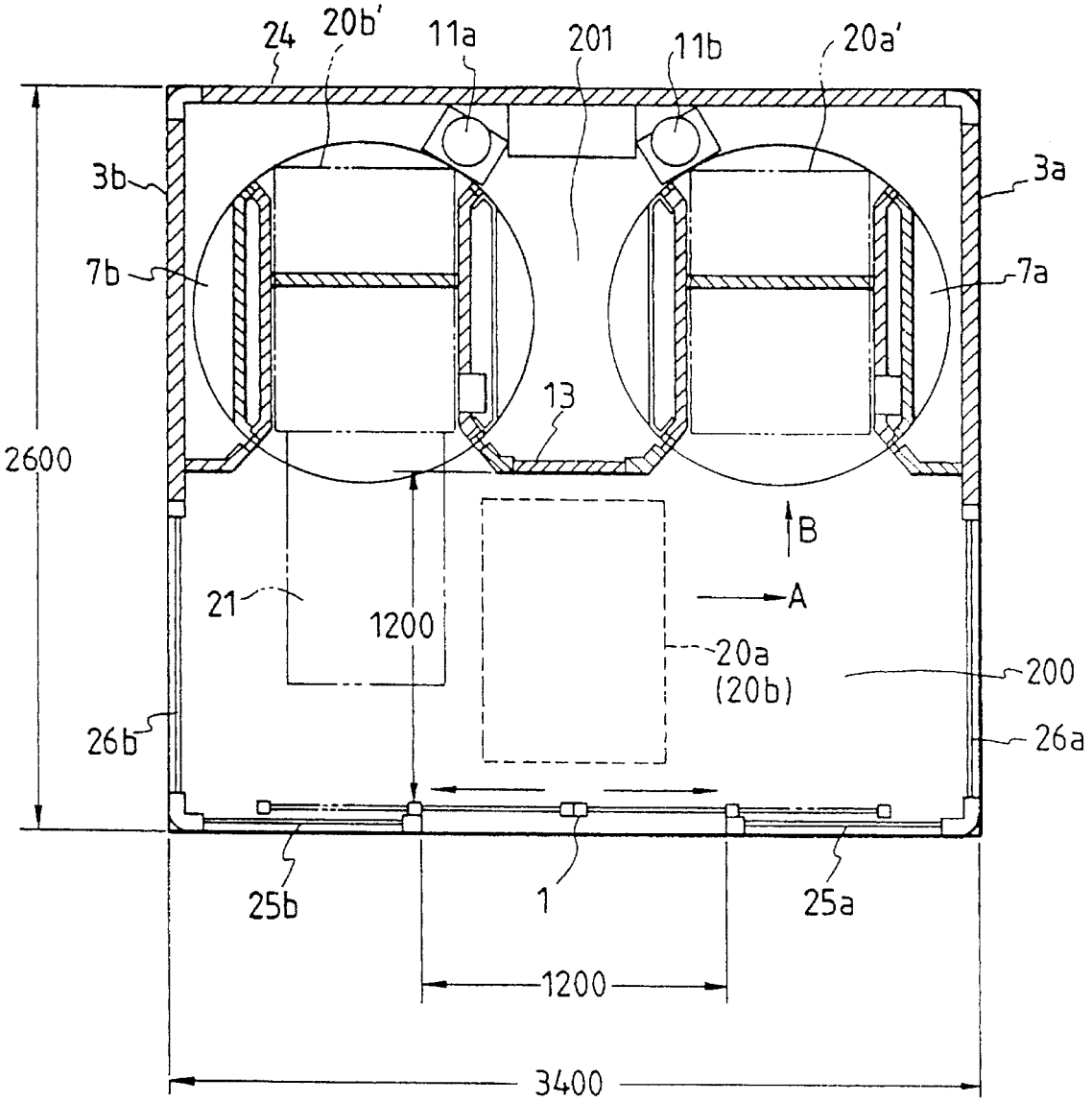
FIG. 6 PRIOR ART
FIG. 6 is a horizontal sectional view of a booth in the prior art.

FIG. 5 is a horizontal sectional view similar to FIG. 6 in the case where the depth of the customer room 200 is decreased. In this case as shown, when the automatic transaction machine 20*a* for example is attempted to be put to the automatic transaction machine set position 20*a'* on the rotating table 7*a*, the automatic transaction machine 20*a* interferes with the front wall 25*a* and so cannot be put to the set position 20*a'*. It is therefore necessary to ensure an increased depth of the customer room 200 as shown in FIG. 6. To the contrary, according to some preferred embodiments of the present invention as shown in FIGS. 1 to 4, two entrances 1*a* and 1*b* are provided in front of the set positions 20*a'* and 20*b'* of the automatic transaction machines 20*a* and 20*b*, respectively. Further, there is defined a space between the set positions 20*a'* and 20*b'* so that either the automatic transaction machine 20*a* or 20*b* can be drawn from the set position 20*a'* or 20*b'* into this space. Moreover, the depth of the booth is set to a value not greater than 2.44 m so that the booth can be carried as an assembly by an ordinary truck.

While the booth shown in FIG. 5 is of a type such that the automatic transaction machines are put on the rotating tables, the circumstances mentioned with reference to FIG. 5 are the same as those in a stationary type of booth such that the automatic transaction machines are not put on the rotating tables.

A first preferred embodiment of the present invention will now be described in detail with reference to FIGS. 1 to 3.

Figure 1:
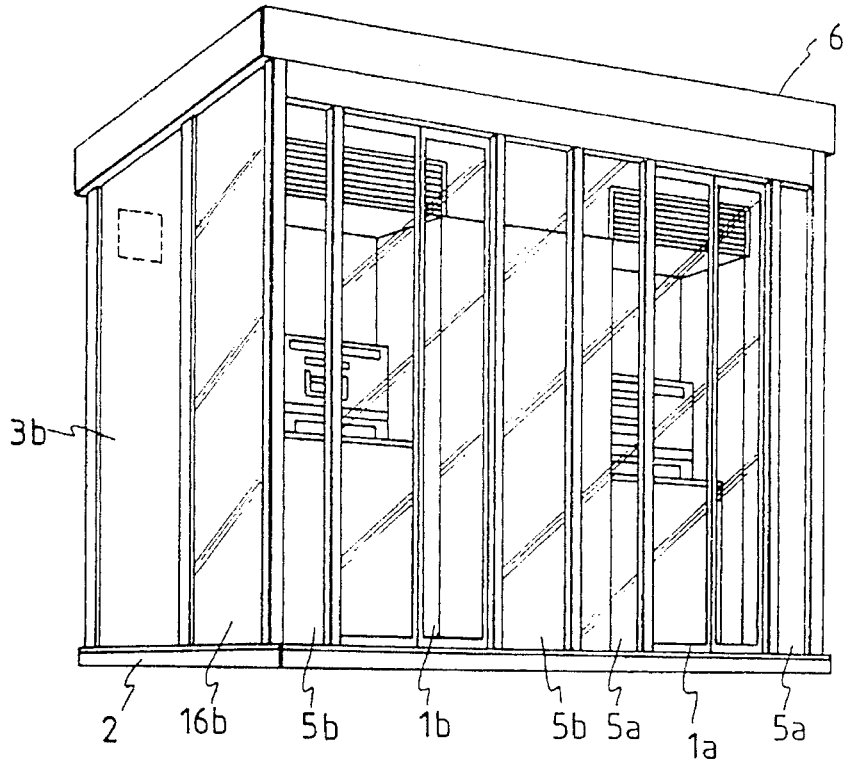
FIG. 1 is a front view in perspective of a booth according to a first preferred embodiment of the present invention.
Figure 2:
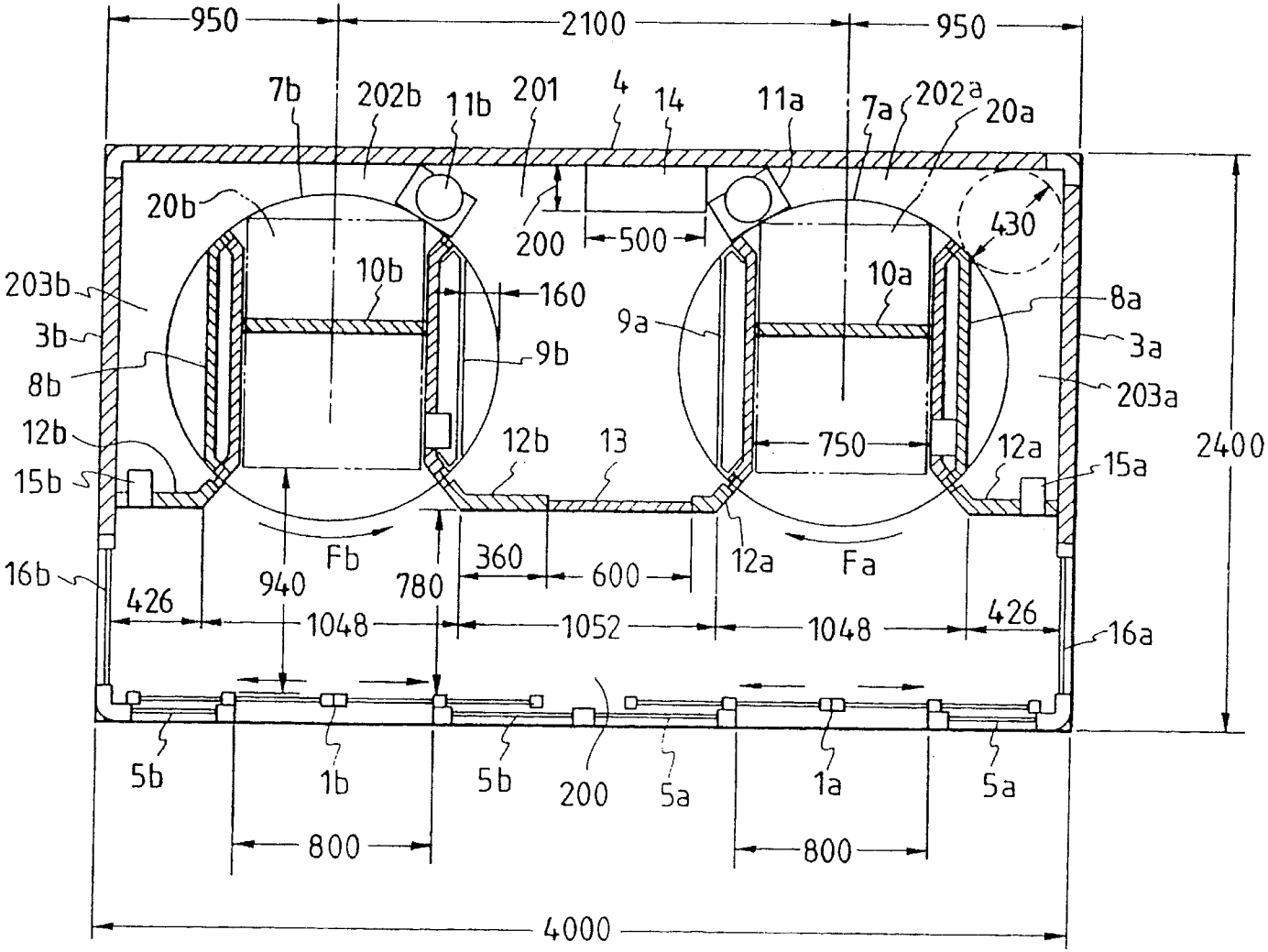
FIG. 2 is a horizontal sectional view of the booth shown in FIG. 1.

FIG. 1 is a perspective view of a booth according to the first preferred embodiment, and FIG. 2 is a horizontal sectional view of the booth shown in FIG. 1. The booth is constructed of two entrances 1*a* and 1*b*, a base (floor) 2, side walls 3*a* and 3*b*, side glass walls 16*a* and 16*b*, a rear wall 4, front glass walls 5*a* and 5*b*, and a roof 6. The side walls 3*a* and 3*b*, the side glass walls 16*a* and 16*b*, the rear wall 4, and the front glass walls 5*a* and 5*b* are fixed to the base 2. There is installed in the booth two rotating tables 7*a* and 7*b*, security panels 8*a* and 8*b*, blindfold panels 9*a* and 9*b*, and partition panels 10*a* and 10*b*. The rotating tables 7*a* and 7*b* are rotatably mounted through suitable rolling elements on the base 2. The security panels 8*a* and 8*b*, the blindfold panels 9*a* and 9*b*, and the partition panels 10*a* and 10*b* are provided to stand on the rotating tables 7*a* and 7*b*, respectively. In closing the booth, the rotating tables 7*a* and 7*b* are rotated at 90 degrees in the directions depicted by arrows Fa and Fb, respectively, to orient the security panels 8*a* and 8*b* toward the front. Two driving motors 11*a* and 11*b* for rotating the rotating tables 7*a* and 7*b* are located in the vicinity thereof, respectively. The inside of the booth is divided into a customer room 200 and a machine room (also serving as a maintenance room) 201 by fixed partitions 12*a* and 12*b* and a maintenance door 13. An operation panel 14 for operating the driving motors 11*a* and 11*b* is provided in the machine room 201. Two operation boxes 15*a* and 15*b* are provided in the customer room 200. Two automatic transaction machines 20*a* and 20*b* are placed on the rotating tables 7*a* and 7*b*, respectively. There are defined two maintenance spaces 202*a* and 203*a* between the rotating table 7*a* and the rear wall 4 and between the rotating table 7*a* and the side wall 3*a*, respectively. Similarly, there are defined two maintenance spaces 202*b* and 203*b* between the rotating table 7*a* and the rear wall 4 and between the rotating table 7*b* and the side wall 3*b*, respectively. These spaces 202*a*, 203*a*, 202*b*, and 203*b* are so sized as to allow one person to pass through.

Figure 3:
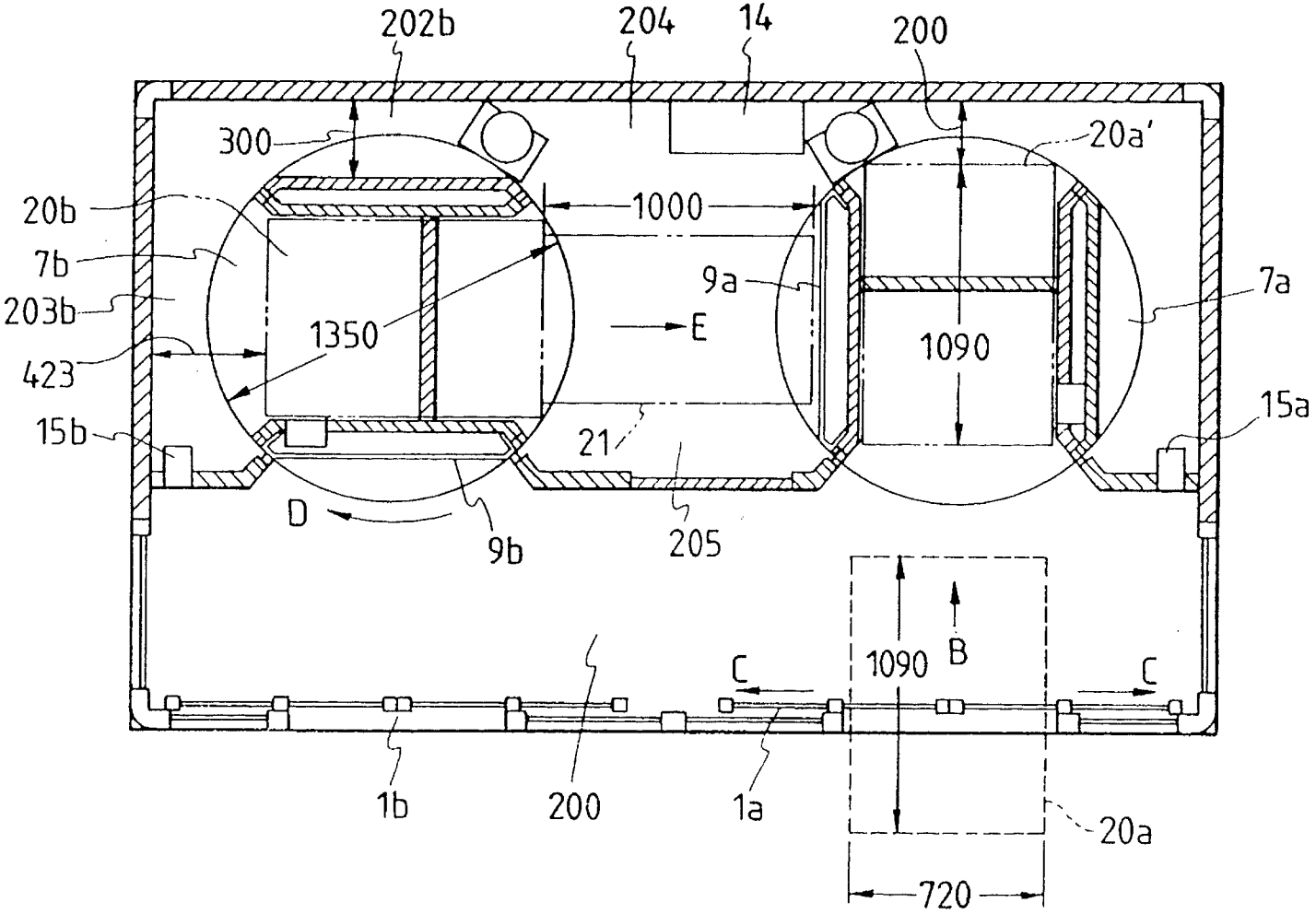
FIG. 3 is a view similar to FIG. 2, illustrating an installation work and a maintenance work in the first preferred embodiment.

While various dimensions of the parts constituting the booth are specified in FIGS. 2 and 3, the dimensions of primary ones of these parts are decided for the following reasons.

The depth of the booth is set to 2400 mm, which corresponds to the width of an ordinary truck, 2440 mm. This depth is decided in consideration of an error in manufacturing the booth, easiness of positioning of the booth on a platform of the ordinary truck in road carrying, a fixing member used in fixing the booth to the platform, etc.

The dimension between the fixed partition 12*a* or 12*b* and the entrance 1*a* or 1*b* is set to 780 mm. This dimension is decided in consideration of a necessary distance such that a customer does not feel any oppression in operating the automatic transaction machine 20*a* or 20*b*.

The dimension between the front surface of the automatic transaction machine 20*a* or 20*b* and the entrance 1*a* or 1*b* is set to 940 mm. This dimension is selected in consideration of a necessary space which will not (e.g., key operation, taking in and out a card or a passbook, etc.) hinder the customer when the customer is operating the automatic transaction machine 20*a* or 20*b*.

The width of each entrance 1*a* or 1*b* is set to 800 mm. This width is decided in consideration of the requirements such that the automatic transaction machine 20*a* or 20*b* and a person can smoothly pass through the entrance 1*a* or 1*b* and that the two entrances 1*a* and 1*b* can be arranged in the width of the booth, 4000 mm and doors of the entrances 1*a* and 1*b* can be smoothly opened and closed without mutual interference.

The width of the machine room 201 is set to 1052 mm. This width is decided in consideration of a minimum necessary space such that a unit 21 (see FIG. 3) of the automatic transaction machine 20*a* or 20*b* drawn into the machine room 201 can be smoothly subjected to maintenance in the machine room 201.

The diameter of each rotating table 7*a* or 7*b* is set to 1350 mm (see FIG. 3). This diameter is decided in consideration of a minimum necessary dimension such that the automatic transaction machine 20*a* or 20*b* can be fully placed on the rotating table 7*a* or 7*b*.

The width of the maintenance space 202*a*, 203*a*, 202*b*, or 203*b* around the automatic transaction machine 20*a* or 20*b* is set to about 300 to 423 mm. This width is decided in consideration of a minimum necessary dimension such that a customer engineer can pass through this maintenance space in performing the maintenance.

The two entrances 1*a* and 1*b* are provided in front of the automatic transaction machines 20*a* and 20*b* for the purpose that the automatic transaction machines 20*a* and 20*b* can be straight carried from the entrances 1*a* and 1*b* to the set positions 20*a'* and 20*b'* on the rotating tables 7*a* and 7*b*, respectively. In addition to this purpose, the following purposes are intended.

(1) If only one of the entrances 1*a* and 1*b* is provided in the booth shown in FIG. 2 with the depth of the customer room 200 set to 780 mm, there is a problem in security such that contact between a customer operating the automatic transaction machine 20*a* or 20*b* and another customer entering the single entrance 1*a* or 1*b* may occur to reduce the operability of the customer operating the automatic transaction machine 20*a* or 20*b* and that the two customers may unduly approach each other.

(2) If a single entrance is provided at the center of the front surface of the booth, there is a problem in security such that a subsequent customer comes near the customer operating the automatic transaction machine 20*a* or 20*b* to wait for his/her turn.

Thus, the two entrances 1*a* and 1*b* corresponding to the automatic transaction machines 20*a* and 20*b* are provided for convenience of the user and to provide security as mentioned in the above paragraphs (1) and (2).

The booth according to the first preferred embodiment is so constructed as to meet the above conditions and store the automatic transaction machines 20*a* and 20*b* in the space having the dimension of 4000 mm in width and 2400 mm in depth. Furthermore, the booth is so designed as to ensure a good operability in the customer room 200 and prevent undue approach of customers in the customer room 200, thus ensuring a good customer service. Moreover, the booth is so designed as to ensure sufficient maintenance space.

The operation will now be described with reference to FIG. 3, in which the left automatic transaction machine 20*b* is shown to have a maintenance position wherein the blind-fold panel 9*b* faces the customer room 200, and the right automatic transaction machine 20*a* is shown to have an open position.

The installation work of the automatic transaction machine 20*a* for example is performed as follows:

The entrance 1*a* provided in front of the set position 20*a'* of the automatic transaction machine 20*a* is opened in opposite directions depicted by arrows C. Then, the automatic transaction machine 20*a* is carried from the entrance 1*a* into the booth, and is moved straight forward to the set position 20*a'* in a direction depicted by an arrow B. Thus, the automatic transaction machine 20*a* is placed on the set position 20*a'*.

The maintenance work of the automatic transaction machine 20*b* for example is performed as follows:

1. The operation panel 14 or the operation box 15*b* is operated to rotate the rotating table 7*b* in a direction depicted by an arrow D, thereby changing the set position of the automatic transaction machine 20*b* into the maintenance position shown in FIG. 3.

2. The unit 21 of the automatic transaction machine 20*b* is drawn to the machine room 201 in a direction depicted by an arrow E. In this condition, the customer engineer standing in a space 204 or 205 performs maintenance or cash exchange which is required.

3. As required, the customer engineer moves through the space 202 to the space 203, in which he/she also performs the maintenance.

As mentioned above, the installation of the automatic transaction machine 20*a* or 20*b* is performed by carrying the automatic transaction machine 20*a* or 20*b* straight from the entrance 1*a* or 1*b* to the corresponding set position 20*a'* or 20*b'*. Further, the maintenance or the cash exchange is performed by drawing the unit 21 of the automatic transaction machine 20*a* or 20*b* to the machine room 201 defined between the automatic transaction machines 20*a* and 20*b*. Accordingly, the depth of the customer room 200 can be greatly reduced. The total installation area of the booth according to this preferred embodiment can be reduced by suppressing an increase in width of the machine room 201 and greatly reducing the depth of the customer room 200. Further, since it is unnecessary to define a large space for performing the carry and the maintenance of the ATMs 20*a* and 20*b* in the customer room 200, the depth of the booth can be reduced to a value not greater than 2.44 m which is the upper limit of an ordinary truck in road carrying.

The operation panel 14 includes a circuit capable of individually operating the rotating tables 7*a* and 7*b*. Accordingly, when one of the automatic transaction machines 20*a* and 20*b* is not working properly, only the automatic transaction machine not working properly can be repaired without any influence upon the other automatic transaction machine.

Further, the operation panel 14 has a remote control circuit for receiving driving signals to the driving motors 11*a* and 11*b* to drive the same and rotate the rotating tables 7*a* and 7*b*, and also has a disconnecting circuit for disconnecting the remote control circuit by switch operation when the automatic transaction machine 20*a* or 20*b* is not working properly. Thus, owing to the provision of this disconnecting circuit, the safety of the customer engineer working in the machine room 201 can be ensured.

Further, the operation boxes 15*a* and 15*b* become effective only when the switch operation of the operation panel 14 is performed, and they are located so as to face the customer room 200. Accordingly, in rotating the rotating table 7*a* or 7*b* to perform the maintenance or the cash exchange, the customer engineer can confirm the safety of the customer in the customer room 200 and then operate the switch boxes 15*a* or 15*b* to rotate the rotating table 7*a* or 7*b*.

Although the two automatic transaction machines 20*a* and 20*b* are provided in the booth according to the above preferred embodiment, three or more automatic transaction machines may be similarly provided.

In the automatic transaction machine storing apparatus according to the first preferred embodiment, the following effects can be exhibited.

1. The workability of installation of the automatic transaction machines can be improved.

2. The safety in the maintenance of the automatic transaction machines or the cash exchange can be improved.

3. The customer room can be reduced in depth to allow the booth to be carried by an ordinary truck.

4. The installation area of the booth can be reduced.

FIG. 4 shows a second preferred embodiment of the present invention, in which stationary type ATMs are provided rather than the use of the rotating tables 7*a* and 7*b* shown in FIGS. 1 to 3, The second preferred embodiment is different from the first preferred embodiment in the points that the front side of each automatic transaction machine is covered with a security shutter in the closed condition of the booth and that the unit 21 of either the automatic transaction machine 20*a* or 20*b* is drawn directly from the set position 20*a'* or 20*b'* to the machine room 201 without rotation. The security shutter is provided so as to separate each automatic transaction machine 20*a* or 20*b* from the customer room 200 in the closed condition of the booth, but is raised in the open condition of the booth. Accordingly, the security shutter does not oppress the customer room 200 and does not influence the depth of the booth. The maintenance space between the automatic transaction machines 20*a* and 20*b* must have at least a drawing dimension of the unit 21. The drawing dimension is set to the width of each automatic transaction machine 20*a* or 20*b*, 750 mm in this preferred embodiment. As compared with the drawing dimension 1000 mm of the unit 21 in the first preferred embodiment employing the rotating tables 7*a* and 7*b*, the drawing dimension 750 mm of the unit 21 in the second preferred embodiment can be made smaller to thereby reduce the width of the booth to 3800 mm. Although the two automatic transaction machines 20*a* and 20*b* are provided in the booth according to this preferred embodiment, three or more automatic transaction machines may be similarly provided.

As similar to the first preferred embodiment, the depth of the booth can be set to 2.4 m which is the upper limit of width of an ordinary truck in road carrying. Other effects similar to those in the first preferred embodiment can be obtained also in the second preferred embodiment.

It should be appreciated that the width 2.44 m of the ordinary truck mentioned above is merely illustrative and it can be set to a larger value within the range defined by the law; so the depth of the booth can accordingly be set to a larger value corresponding to the increased width of the ordinary truck.

Figure 14:
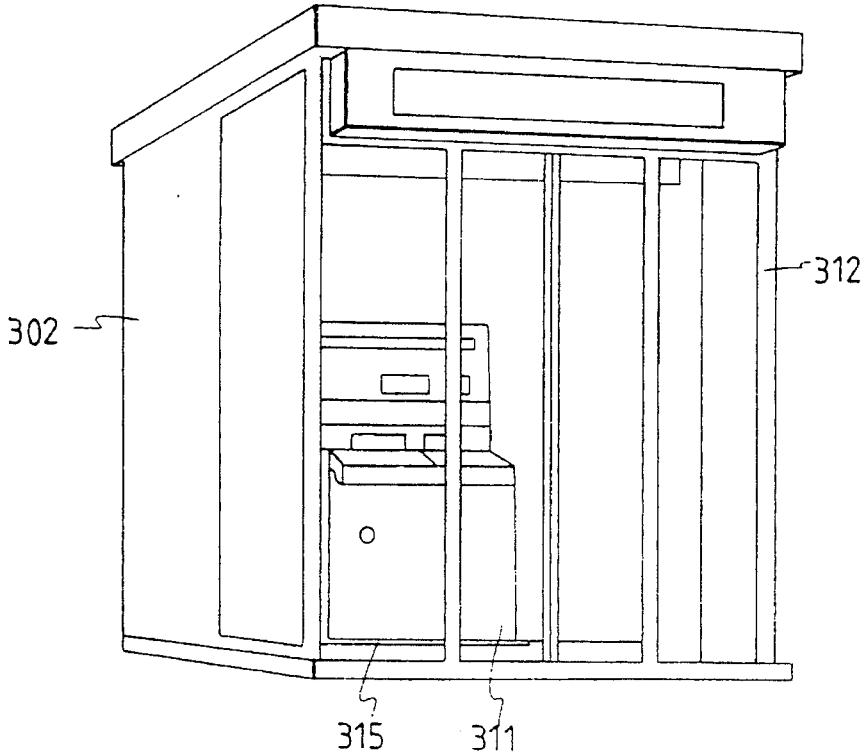
FIG. 14 is a front view in perspective of the booth according to the third preferred embodiment.

FIG. 14 is a perspective view showing an automatic transaction machine storing apparatus according to a third preferred embodiment of the present invention, in which there is shown an automatic transaction machine 311 stored in a capsule booth 312 and placed on a rotating table 315.

Figure 9:
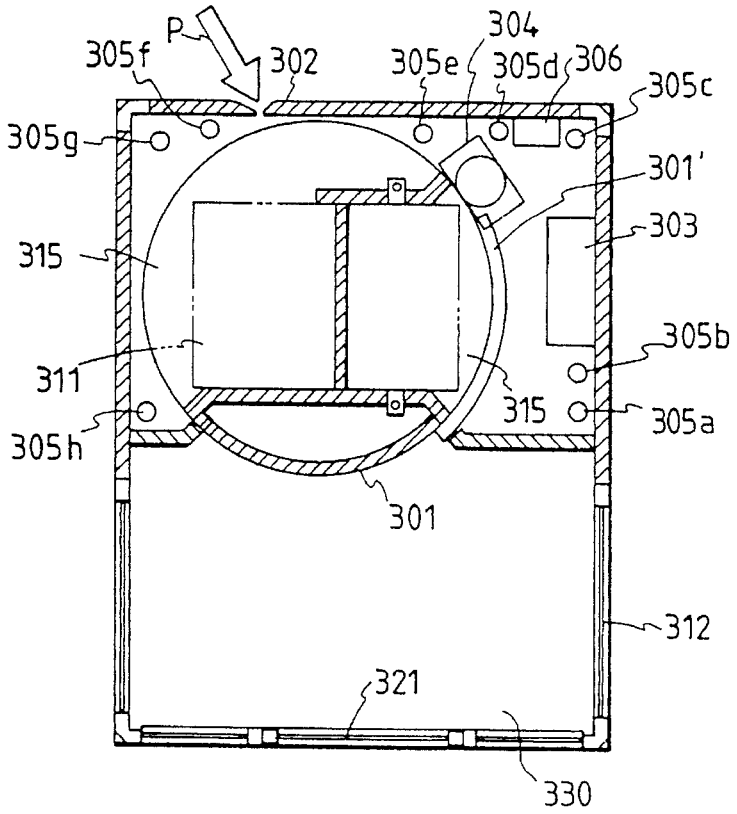
FIG. 9 is a view similar to FIG. 8, showing a condition where a flame from the gas burner breaks the outer panel to reach the inside of the booth.
Figure 10:
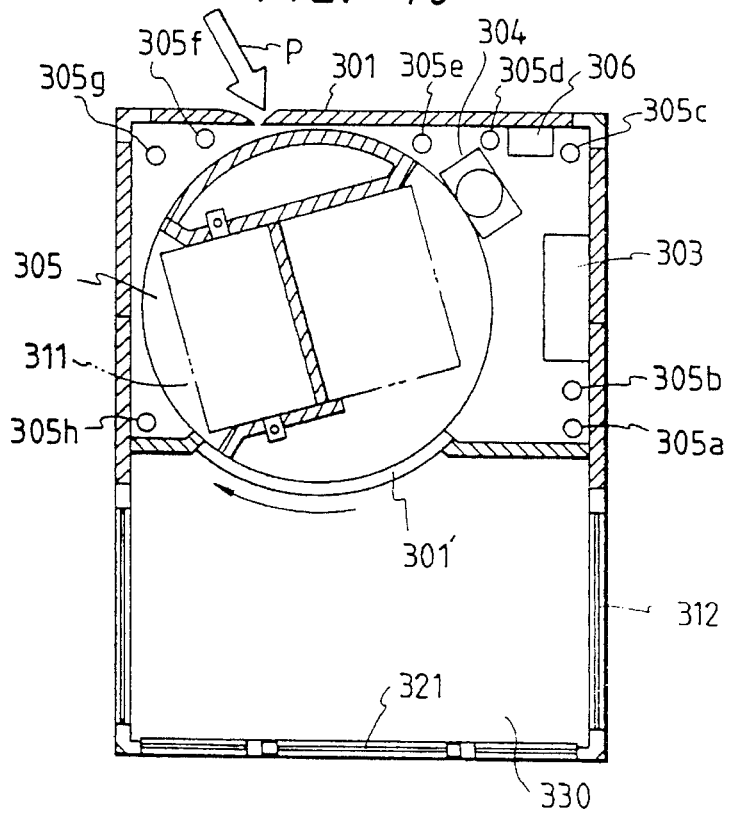
FIG. 10 is a view similar to FIG. 9, showing a condition where the condition of FIG. 9 is detected by security sensors and a rotating table is then rotated.
Figure 11:
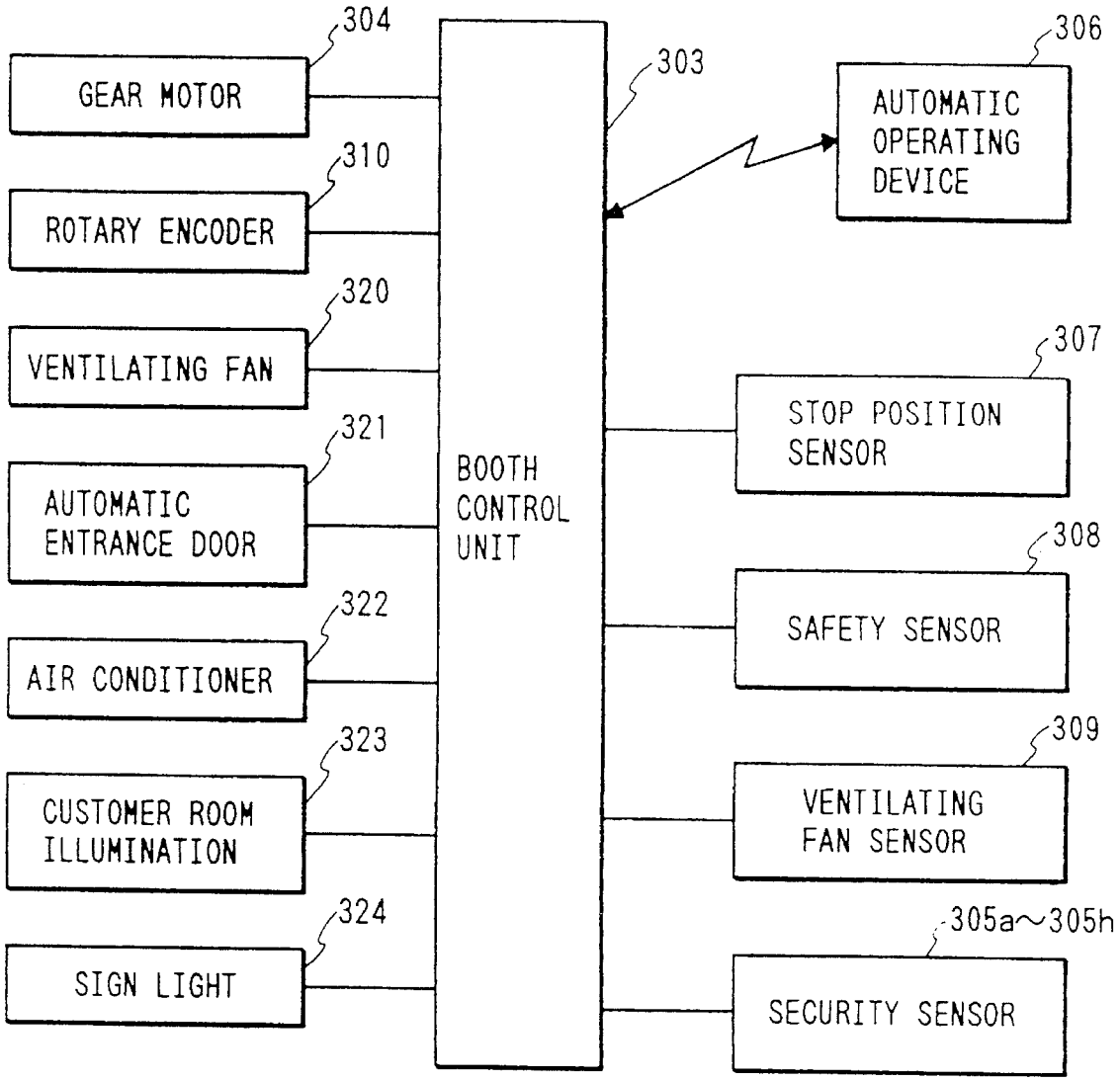
FIG. 11 is a block diagram of a control system in the third preferred embodiment.

FIGS. 7 to 10 are horizontal sectional views of the capsule booth 312, and FIG. 11 is a block diagram of a control system in the capsule booth 312.

Referring to FIGS. 7 to 11, the capsule booth 312 as the automatic transaction machine storing apparatus includes the automatic transaction machine 311, the rotating table 315, a security panel 301 standing on the rotating table 315 for securing the automatic transaction machine 311 from any external attack, an outer panel 302 defining the inside space of the booth, a control unit 303 for controlling the operation of equipment provided in the booth, an automatic operating device 306, a gear motor 304 for driving the rotating table 315, a rotary encoder 310, a plurality of security sensor units 305*a* to 305*h* for detecting any attack on the booth, a position sensor 307 for detecting a stop position of the rotating table 315, a safety sensor 308 for detecting pass of a person or anything near the rotating table 315 during its rotation, a ventilating fan sensor 309 for detecting a temperature in the booth, a ventilating fan 320, an automatic entrance door 321, an air conditioner 322, a customer room illumination 323, and a sign light 324.

The control unit 303 receives a signal from the automatic operating device 306, and a sequence controller in the control unit 303 performs computation to control the equipment in the booth.

The gear motor 304 operates to rotate the rotating table 315 to one of three positions, i.e., an open position, a closed position, and a maintenance position according to a signal from the automatic operating device 306. The stop position of the rotating table 315 during rotation is detected by the position sensor 307, and the control unit 303 controls to stop the gear motor 304 according to a signal from the position sensor 307. The passing of a person or anything near the rotating table 315 during rotation is detected by the safety sensor 308, and the control unit 303 controls to urgently stop the gear motor 304 according to a signal from the safety sensor 308.

Further, the automatic entrance door 321, the air conditioner 322, the customer room illumination 323, and the sign light 324 are on/off controlled by the control unit 303 in receipt of a signal from the automatic operating device 306. The ventilating fan 330 is provided to prevent an abnormal rise in temperature in the booth, and it is controlled to be driven by the control unit 303 according to a signal from the ventilating fan sensor 309.

The security function of the capsule booth 312 in this preferred embodiment will now be described with reference to FIGS. 7 to 10.

Figure 7:
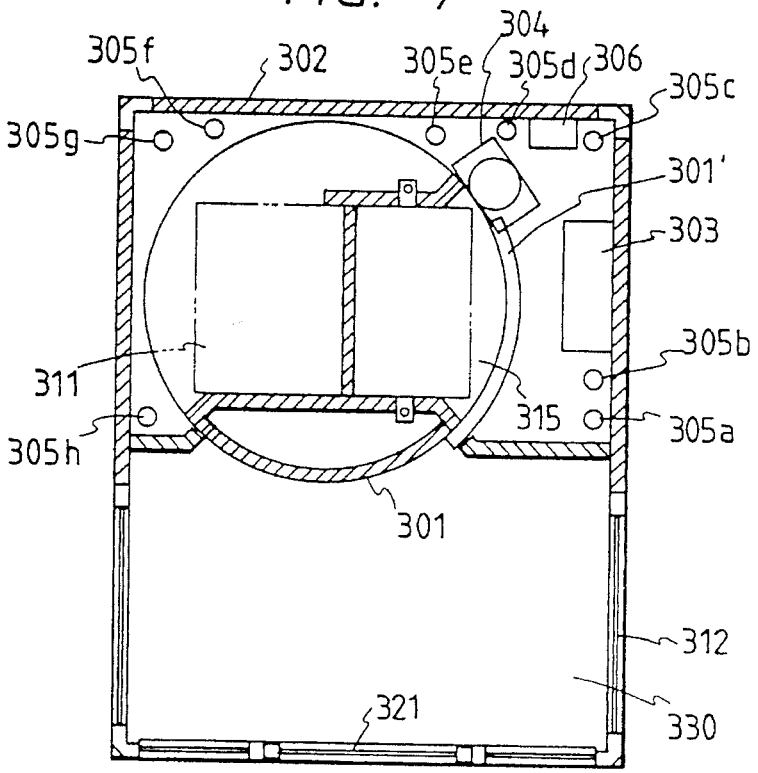
FIG. 7 is a horizontal sectional view of a booth according to a third preferred embodiment of the present invention, showing a closed condition of the booth.

FIG. 7 shows a closed condition of the capsule booth 312. In this condition, the automatic transaction machine 311 is partitioned from the customer room 330 by the security panel 301, thereby preventing intrusion of any person into the side of the automatic transaction machine 311.

Figure 8:
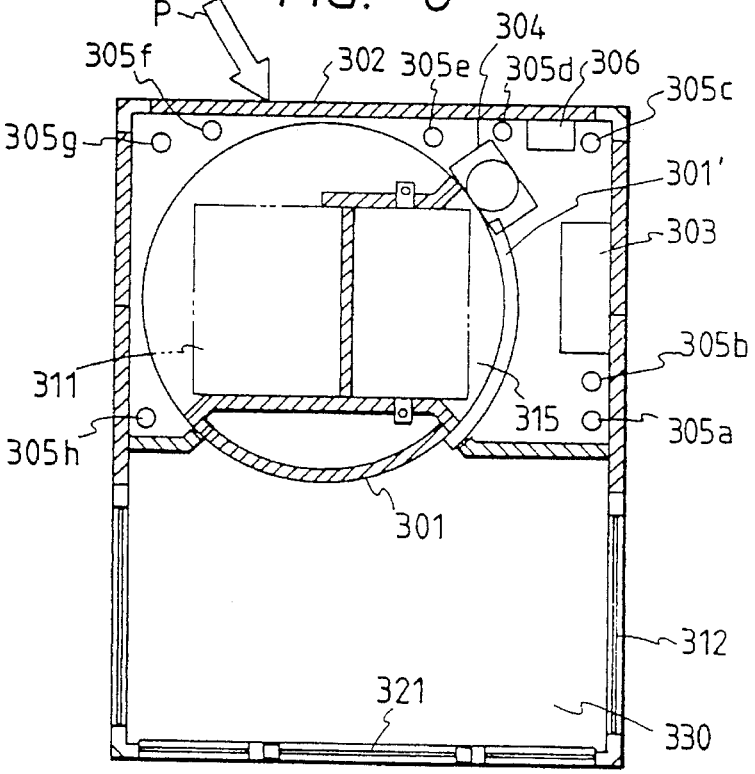
FIG. 8 is a view similar to FIG. 7, showing a condition where an outer panel of the booth is attacked by a gas burner.

FIG. 8 shows a condition where the rear wall of the outer panel 302 is attacked by a gas burner as shown by an arrow P in the closed condition of the booth 312.

FIG. 9 shows a condition subsequent to the condition of FIG. 8, in which the flame from the gas burner breaks the outer panel 302 to reach the inside of the booth 312. At this time, the security sensor units 305*a* to 305*h* detect heat or light due to the flame from the gas burner, or vibration due to the breakage of the outer panel 302 by the flame from the gas burner.

FIG. 10 shows a condition subsequent to the condition of FIG. 9, in which the rotating table 315 is rotated to orient the security panel 301 toward an attacked position of the outer panel 302 according to information from the security sensor units 305*a* to 305*h*. More specifically, when the security sensor units 305*g* and 305*h*, for example, first detect heat or light of the flame from the gas burner, the control unit 303 receives information from the security sensor units 305*g* and 305*h* to compute a direction of attack on the outer panel 302 from the locations of the security sensor units 305*g* and 305*h* and rotate the rotating table 315 at an optimum angle, thus orienting the security panel 301 toward the attacked position to secure the automatic transaction machine 311 against the attack.

Figure 12:
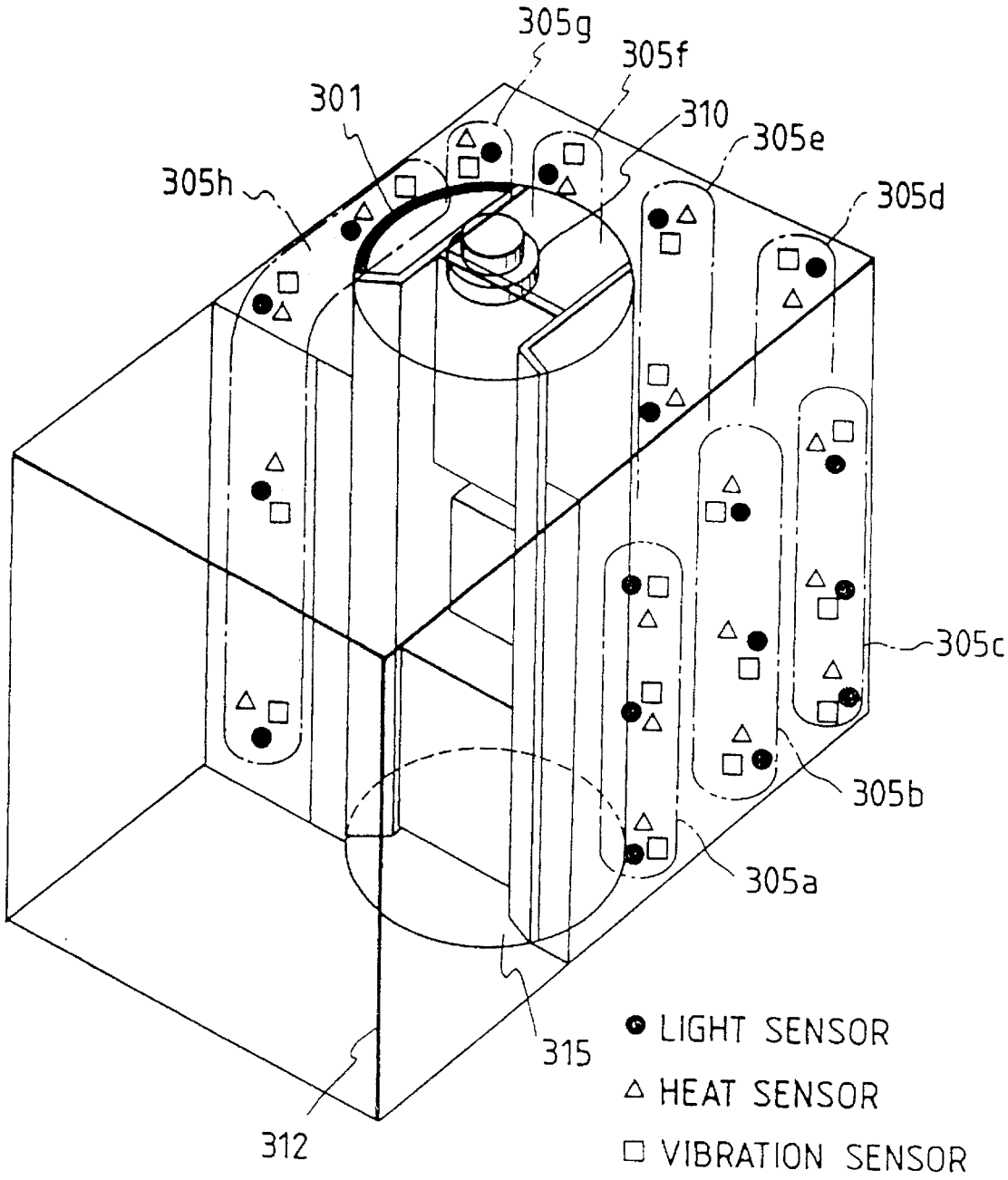
FIG. 12 is a schematic perspective view showing the arrangement of the security sensors provided in the booth.

As shown in FIG. 12, each of the security sensor units 305*a* to 305*h* is composed of a plurality of sets of light sensors, heat sensors, and vibration sensors (noise sensors). That is, each set is composed of a light sensor, a heat sensor, and a vibration sensor. These security sensor units 305*a* to 305*h* are dispersedly located on the inner wall surface of the outer panel 302. The locations of the security sensor units 305*a* to 305*h* are previously stored as status (number) in the control unit 303, so that the control unit 303 can identify the locations of any of the security sensor units 305*a* to 305*h* which have detected the attack. Then, the control unit 303 computes a rotational angle of the security panel 315 mounted on the rotating table 315 to be rotated to the attacked position, according to the location information of the security sensor units 305*a* to 305*h*. A rotational position of the rotating table 315 on the basis of the security panel 301 is always input in a computing circuit of the control unit 303.

Information for detecting the rotational position of the rotating table 315 is obtained by the rotary encoder 310 shown in FIG. 12. The rotary encoder 310 has a structure such that a fixed cylinder and a rotating cylinder are concentrically arranged in a stacked condition. Switches provided on the outer circumference of the rotating cylinder are adapted to come into contact with switches provided on the outer circumference of the fixed cylinder at given intervals to generate a signal and obtain the rotational position of the rotating table 315. According to the rotational position information from the rotary encoder 310, the control unit 303 computes a rotational angle of the rotating table 315 to rotate it at this computed angle, thus orienting the security panel 301 toward the attacked position of the outer panel 302 to secure the automatic transaction machine 311 against the attack.

Figure 13:
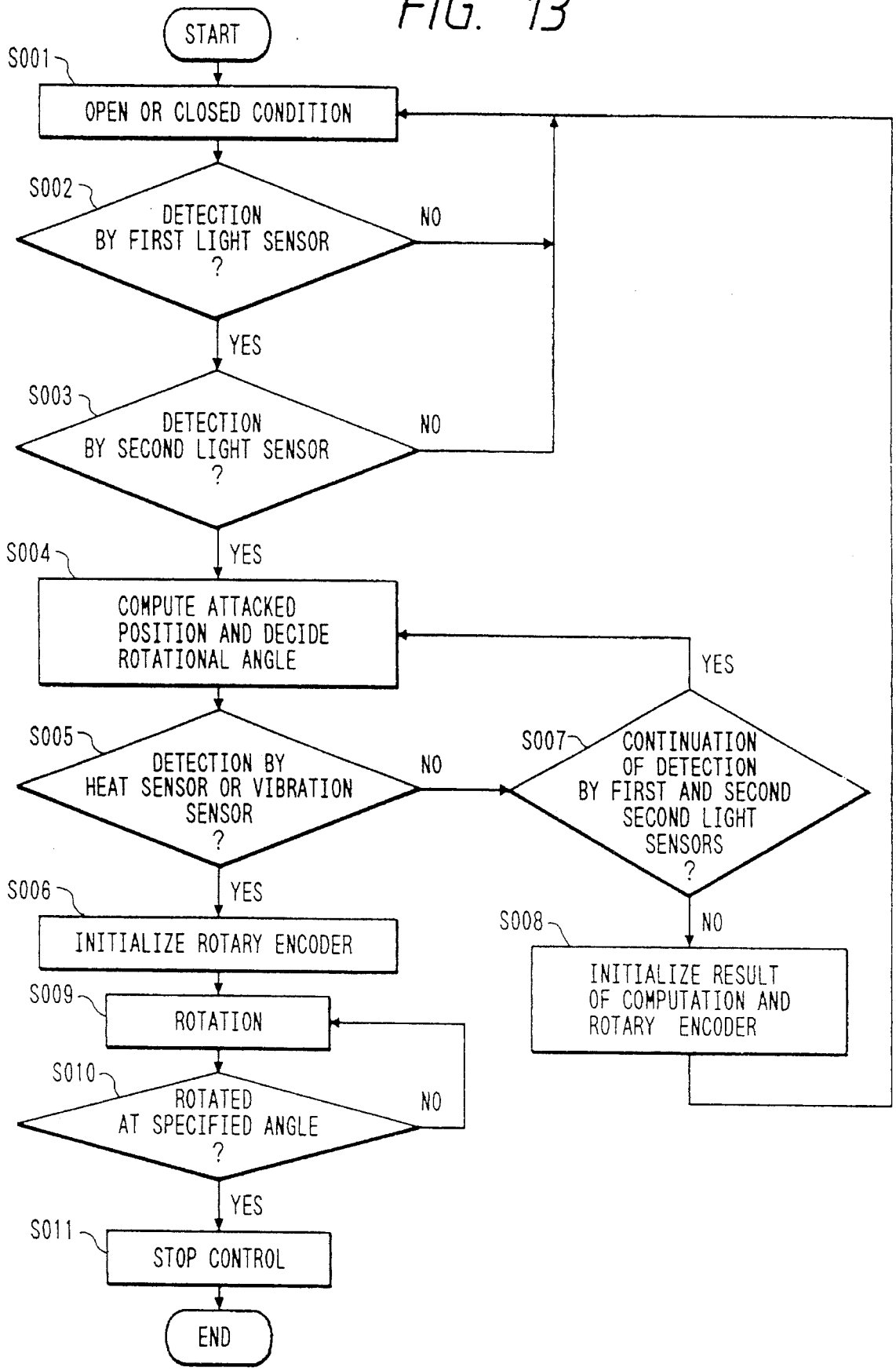
FIG. 13 is a flowchart showing a security operation in the third preferred embodiment.

FIG. 13 is a flowchart showing the security operation mentioned above. Some primary steps in the security operation will be described with reference to FIG. 13.

S001: The booth 312 is in the open condition or the closed condition shown in FIG. 7.

S002: Any light sensor of the first security sensor unit 305*g* , for example detects light.

S003: Subsequently, any light sensor of the second security sensor unit 305*h*, for example, detects light.

In this manner, a position of light source can be detected according to information from the light sensors located at two different positions.

S004: The control unit 303 decides a rotational angle of the rotating table 315 to be rotated to the position of the light source, and enters a waiting state for rotation of the rotating table 315.

S005: If any heat sensors or any vibration sensors of the first and second security sensors additionally detect heat or vibration, the control unit 303 determines that an abnormal condition such as an attack on the outer panel 302 has occurred.

S006: The control unit 303 initializes the rotational angle of the rotary encoder 310 before rotating the rotating table 315.

S007: If the heat sensors or the vibration sensors do not detect heat or vibration in S005 and the heat sensors continue to detect light, the program returns to S004, whereas if the light sensors do not continue to detect light, the program proceeds to S008.

S008: The control unit 303 initializes the result of computation and the rotational angle of the rotary encoder 310, then returning to S001.

S009: The control unit 303 rotates the rotating table 315 at the above decided angle.

S010: The control unit 303 checks whether or not the rotating table 315 has been rotated at the above decided angle.

S011: After the rotation at the decided angle is checked, the control unit 303 stops the control operation.

The control unit 303 and the rotary encoder 310 constitute the drive control means according to the present invention.

As shown in FIG. 10, it is more preferable from the viewpoint of security that an auxiliary panel 301' is driven in concert with the movement of the security panel 301 but irrespective of the rotation of the rotating table 315 to isolate the automatic transaction machine 311 from the customer room 330. For instance, the auxiliary panel 301' is controlled to be driven when the movement of the security panel 301 is detected.

As apparent from the above description, according to an aspect of the present invention, the workability of installation of the automatic transaction machines can be improved, and the booth can be carried by an ordinary truck.

Further, according to another aspect of the present invention, the security of the automatic transaction machine can be effectively controlled according to information from the detecting means provided in the booth without receiving any command from a host system, that is, without any limitation relating to an interface.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In an automatic transaction machine storing apparatus having a plurality of mounting portions spaced in a lateral direction of said apparatus, a customer room defined in front of said mounting portions, and a plurality of automatic transaction machine receiving portions, wherein a plurality of automatic transaction machines are mounted to respective ones of said mounting portions, and said automatic transaction machine receiving portions are open to said customer room in an operative condition of said automatic transaction machines; the improvement comprising:

a maintenance section provided between adjacent ones of said mounting portions, said maintenance section having a width not less than a width of each of said automatic transaction machines; and a plurality of entrances respectively provided in opposed relationship to said receiving portions to allow said automatic transaction machines to be carried therethrough into said receiving portions;

wherein a depth of said automatic transaction machine storing apparatus is set to a value not greater than 2.5 m.

2. An automatic transaction machine storing apparatus according to claim 1, further comprising a side wall spaced from said mounting portions and an additional maintenance section provided between said side wall and said mounting portions.

3. In an automatic transaction machine storing apparatus having a plurality of rotating tables spaced in a lateral direction of said apparatus, a customer room defined in front of said rotating tables, and a plurality of automatic transaction machine receiving portions respectively standing on said rotating tables, wherein a plurality of automatic transaction machines are mounted to respective ones of said mounting portions, and said automatic transaction machine receiving portions are open to said customer room in an operative condition of said automatic transaction machines; the improvement comprising:

a maintenance section provided between adjacent ones of said rotating tables, said maintenance section having a space into which each of said automatic transaction machines is allowed to be drawn; and a plurality of entrances respectively provided in opposed relationship to said receiving portions to allow said automatic transaction machines to be carried therethrough into said receiving portions;

wherein a depth of said automatic transaction machine storing apparatus is set to a value not greater than 2.5 m.

4. An automatic transaction machine storing apparatus according to claim 3, wherein said rotating tables are rotatable independently of each other.

5. An automatic transaction machine storing apparatus according to claim 3, wherein one of said adjacent rotating tables is rotated to 90 degrees to make said receiving portion standing on said rotating table rotated open to said maintenance section, whereby said automatic transaction machine mounted on said rotating table rotated is allowed to be drawn from said receiving portion into said maintenance section.

6. An automatic transaction machine storing apparatus according to claim 3, further comprising an operation panel provided in said maintenance section, said operation panel having a function of cutting off a remote control command instructing rotation of said rotating tables.

7. An automatic transaction machine storing apparatus according to claim 6, further comprising an operation box provided in said customer room, said operation box being made effective in operation by a switch operation of said operation panel.

8. An automatic transaction machine storing apparatus according to claim 3, further comprising a side wall spaced from said rotating tables and an additional maintenance section provided between said side wall and said rotating tables.

9. In an automatic transaction machine storing apparatus having a rotating table, a security panel standing on said rotating table along an outer circumference thereof, and an outer panel, wherein a plurality of automatic transaction machines are mounted to respective ones of said mounting portions, and said outer panel surrounds said automatic transaction machine and said rotating table; the improvement comprising:

detecting means provided on an inside surface of said outer panel for detecting an abnormality having occurred on said outer panel; and drive control means for rotationally driving said rotating table at a required angle according to information output from said detecting means.

* * * * *

UNITED STATES PATENT AND TRADEMARK OFFICE

CERTIFICATE OF CORRECTION

PATENT NO. : 5,526,615

DATED : June 18, 1996

INVENTOR(S) : Takuya Kaizu et al.

It is certified that error appears in the above-indentified patent and that said Letters Patent is hereby corrected as shown below:

Column 12,

Claim 3, line 26, delete "mounting portions" and insert therefor --rotating tables--.

Claim 9, column 13, line 2, delete "a plurality of" and insert therefor --an--.

Claim 9, column 13, line 3, delete "machines are" and insert therefor --machine is--.

Claim 9, column 13, lines 3-4, delete "respective ones of said mounting portions" and insert therefor --said rotating table--.

Signed and Sealed this

Twenty-seventh Day of August, 1996

Bruce Lehman

*Attest:*

BRUCE LEHMAN

*Attesting Officer*

*Commissioner of Patents and Trademarks*